US005732412A

United States Patent [19]

Holden

[11] Patent Number: 5,732,412

[45] Date of Patent: Mar. 31, 1998

[54] KNEE PAD ATTACHMENT

[76] Inventor: Kevin D. Holden, 303 1770 Davie Street, Vancouver, British Columbia, Canada, V6G 1W4

[21] Appl. No.: 721,355

[22] Filed: Sep. 26, 1996

[51] Int. Cl.[6] ..... A41D 13/06

[52] U.S. Cl. ..... 2/23; 2/267; 2/911

[58] Field of Search ..... 2/455, 456, 465, 2/2.5, 22, 23, 24, 46, 62, 267, 242, 919, 911

[56] References Cited

U.S. PATENT DOCUMENTS

| | | | |
|---|---|---|---|
| 2,030,135 | 2/1936 | Carpenter | 450/81 |
| 2,561,872 | 7/1951 | Krinick | 2/24 |
| 2,626,394 | 1/1953 | Davis | 2/24 |
| 4,893,355 | 1/1990 | Ritter | 2/24 |
| 5,350,776 | 9/1994 | Raad | 521/54 |

*Primary Examiner*—Jeanette E. Chapman
*Attorney, Agent, or Firm*—Michael I. Kroll

[57] ABSTRACT

A knee pad (16) for cushioning a knee of a person (18) wearing a pair of pants (20), when the person (18) is in a kneeling position. The knee pad (16) comprises a cushion member (22) being a flexible semi-cylindrical body section (24) having a flat outer surface contact area (26) with tapered sides (28) and an integral flexible quadrispherical cut back top section (30). A facility (32) is for attaching the cushion member (22) in a removable manner to a pants leg (34) of the pair of pants (20) at a knee area. When the person (18) goes into the kneeling position on a floor/ground (36), the cushion member (22) will better conform to the knee of the person (18). The flat outer surface contact area (26) will distribute weight more evenly over a wider surface area on the floor/ground (36).

14 Claims, 5 Drawing Sheets

KNEE PAD ATTACHMENT

DESCRIPTION OF THE PRIOR ART

Numerous protective cushions have been provided in prior art. For example, U.S. Pat. Nos. 2,572,360 to Logan; 4,723,322 to Shelby; 4,831,666 to Denman; 4,893,355 to Ritter; 5,309,570 to Grimm; Des. 336,548 to Zeller; Des. 347,301 to Levine; Des. 351,255 to Pytlewski and Des. 354,590 to Paikos et al. all are illustrative of such prior art. While these units may be suitable for the particular purpose to which they address, they would not be as suitable for the purposes of the present invention as heretofore described.

BACKGROUND OF THE INVENTION

Field of the Invention

The instant invention relates generally to protective cushions and more specifically it relates to a knee pad.

LOGAN, ROLAND F.

INJURY PAD

U.S. Pat. No. 2,572,360

A pre-formed injury pad consisting of a flexible semi-cylindrical body section. A flexible quadrispherical end section is provided. An inelastic fabric facing is attached only to the entire outer surface of the semi-cylindrical body section.

SHELBY, JAMES E.

KNEE PAD ATTACHMENT

U.S. Pat. No. 4,723,322

A knee pad for use on a supporting surface, and not attached to a person's knee, to provide support and cushioning to a person's knee. The pad has a lower region having a bottom for contacting the supporting surface, and a contoured upper region for contacting the front portion of the person's knee. The bottom has a frictional surface to resist sliding with respect to the supporting surface. Various properties of the upper region, relating to its contours and fitting with respect to the knee, are disclosed, particularly a concavity in the top of the pad. The concavity may be vacant. The top of the concavity may adjoin the top of the pad. The concavity may have a secondary inner concavity perimeter. The pad may have a plurality of outer perimeters, defining decreasing areas within the perimeters, from bottom to top of the pad.

DENMAN, ROBERT Z.

GARMENT ESPECIALLY ADAPTED FOR PROTECTING THE KNEES WHILE GARDENING

U.S. Pat. No. 4,831,666

A garment or pant specifically adapted for providing protection to a person's knees in kneeling position while performing gardening or like chores, is disclosed. The garment has a pair of legs, and a pocket affixed to the exterior of each leg. A padded cushioning member is substantially fixedly held in each pocket. The pockets are affixed to the legs in such positions that the pockets and the cushioning member register in the appropriate positions, to provide a cushioning and insulating barrier between the wearer's knees and the ground when the wearer is in kneeling position.

RITTER, WILLIAM H.

KNEE PROTECTOR

U.S. Pat. No. 4,893,355

A knee protector covers the front of the knee, and extends rearwardly on both sides to protect against mechanical damage to the knee. The protector has foamed padding towards the leg for both comfort and mechanical protection, and a somewhat rigid outer shell to provide strength. For comfort as the leg is flexed, the front of the knee protector has a line about which the rigid shell can move, so that two sections of the shell are articulated, allowing movement in all directions. One side of the knee protector can be shortened to allow the use of a knee splint in conjunction with the knee protector.

GRIMM, THOMAS M.

KNEE PAD

U.S. Pat. No. 5,309,570

A knee pad includes a base member which, when unassembled, is planar. A top member is operatively connected to the base member. In a preferred embodiment, the top member is also, when unassembled, planar. The base member has first and second points of attachment and, when unassembled, are at a first distance from each other. The top member has first and second points of attachment which, when unassembled, are also a first distance from each other. Provided are means for securing the top member to the base member at the points of attachment wherein, when assembled, the first and second points of attachment of the base member are at a second distance from each other. The second distance is less than the first distance wherein the base member forms a cupped region. Also provided is a means for attaching the base and top members to a user's knee.

ZELLER, MARVIN

DETACHABLE KNEE PAD

U.S. Pat. No. Des. 336,548

The ornamental design for a detachable knee pad, as shown and described.

LEVINE, NORMAN D.

PROTECTIVE KNEE PAD FOR USE BY SNOWBOARDERS, ROLLER BLADERS, SKATERS, ETC.

U.S. Pat. No. Des. 347,301

The ornamental design for a protective knee pad for use by snowboarders, roller bladers, skaters, etc., as shown in described.

Figure 1:
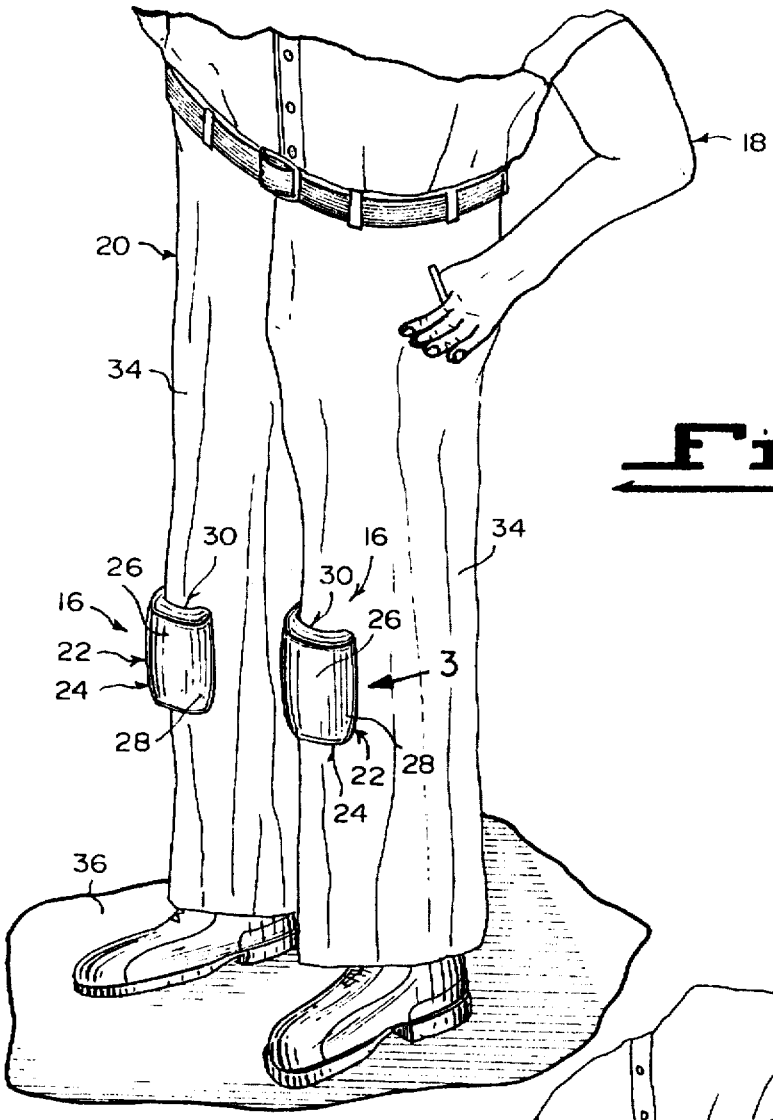
FIG. 1 is a top perspective view of a detachable knee pad showing the new design.
Figure 2:
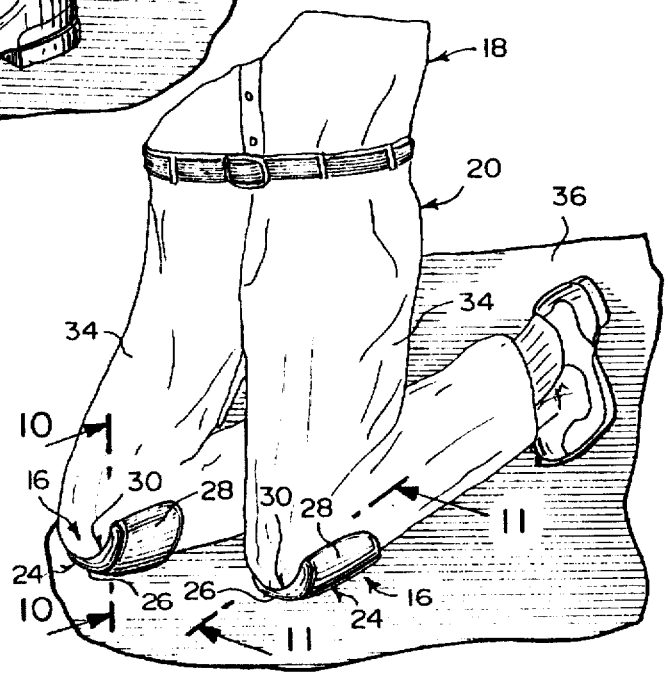
FIG. 2 is an end elevational view thereof, the opposite end being a mirror image.
Figure 3:
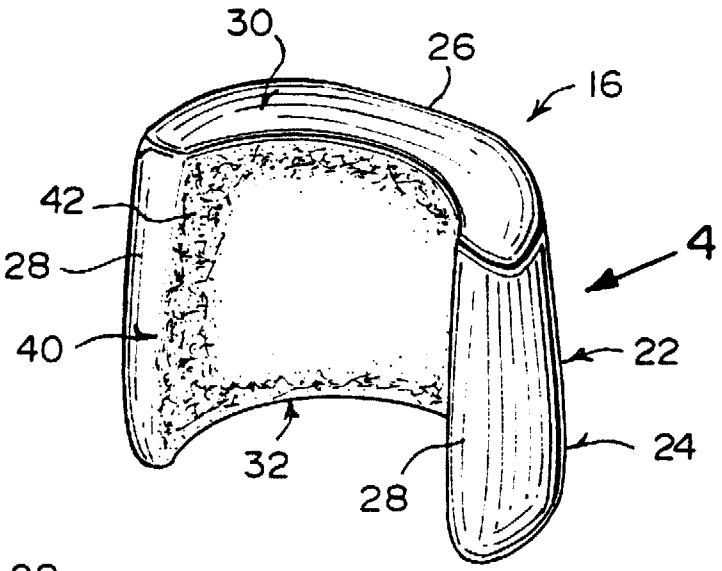
FIG. 3 is a side elevational view thereof, the opposite side being a mirror image.
Figure 4:
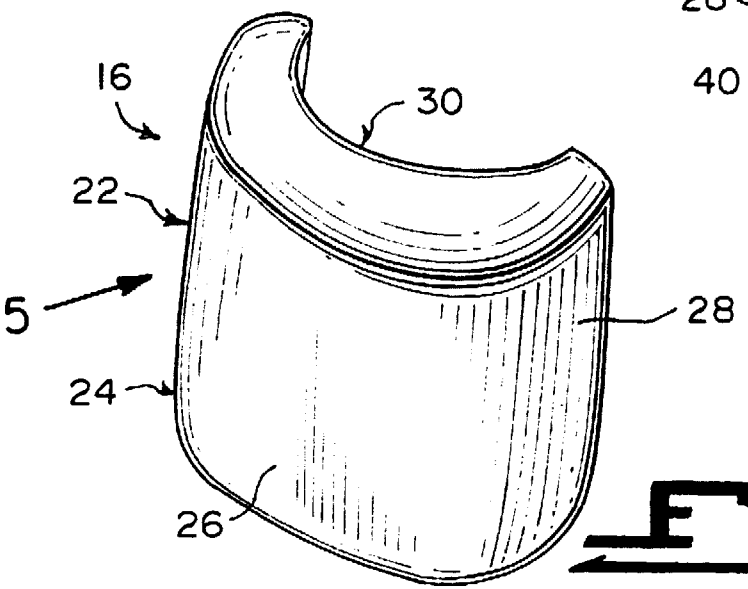
FIG. 4 is a bottom plan view thereof.
Figure 5:
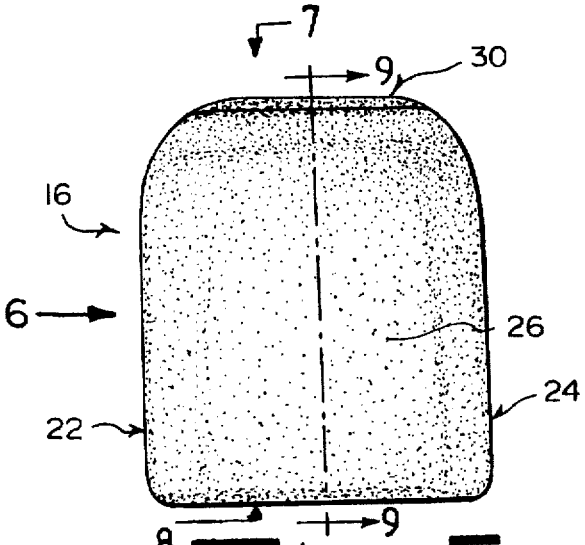
FIG. 5 is a top plan view thereof.

FIG. 1 is a front elevational view of a protective knee pad for use by snowboarders, roller bladers, skaters, etc., showing the new design;

FIG. 2 is a rear elevational view thereof;

FIG. 3 is a left side elevational view thereof;

FIG. 4 is a right side elevational view thereof;

FIG. 5 is a top plan view thereof; and

Figure 6:
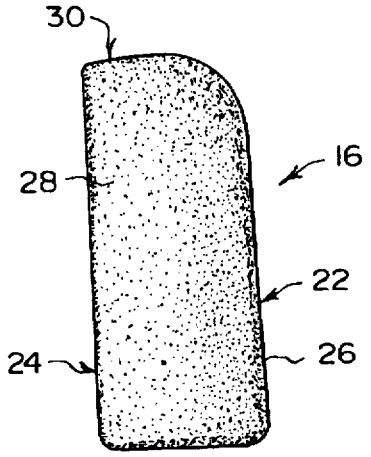

FIG. 6 is a bottom plan view thereof.

The cross-hatching in FIGS. 1–6, represents fabric and is understood to extend throughout the area represented.

PYTLEWSKI, WALTER W.

KNEE PAD

U.S. Pat. No. Des. 351,255

The ornamental design for a knee pad, as shown.

FIG. 1 is a top rear perspective view of a knee pad embodying the new design;

FIG. 2 is a front elevational view of the knee pad of FIG. 1; and

FIG. 3 is a side elevational view of the knee pad of FIG. 1.

PAIKOS, GEORGE P.

LONG, DAVID J.

PROTECTIVE KNEE PAD

U.S. Pat. No. Des. 354,590

The ornamental design for a protective knee pad, as shown and described.

FIG. 1 is a perspective view of front, right and top of a protective knee pad embodying the new design;

FIG. 2 is a right side elevational view thereof, the left side being a mirror image of the right side;

FIG. 3 is a front elevational view thereof;

FIG. 4 is a rear elevational view thereof;

FIG. 5 is a top plan view thereof; and

FIG. 6 is a bottom plan view thereof.

The crosshatch surface shading showing on the strap in FIGS. 1–4 and 6 is understood to repeat throughout the indicated area. The strap is shown broken away in FIG. 4 for clarity of illustration.

SUMMARY OF THE INVENTION

A primary object of the present invention is to provide a knee pad that will overcome the shortcomings of the prior art devices.

Another object is to provide a knee pad having a wide flat contact surface for a more even weight distribution to increase protection to a knee of a person, when kneeling on the floor or ground.

An additional object is to provide a knee pad with stick on and VELCRO attachments, so as to better cling to a knee area on a pair of pants more quickly.

A further object is to provide a knee pad that is simple and easy to use.

A still further object is to provide a knee pad that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view with parts broken away, of a person standing on a floor wearing the instant invention on a pair of pants at the knees.

FIG. 2 is a front perspective view similar to FIG. 1, but with the person kneeling on the floor.

FIG. 3 is a rear perspective view of the instant invention per se taken in the direction of arrow 3 in FIG. 1.

FIG. 4 is a front perspective view taken in the direction of arrow 4 in FIG. 3.

FIG. 5 is a front elevational view taken in the direction of arrow 5 in FIG. 4.

FIG. 6 is a side elevational view taken in the direction of arrow 6 in FIG. 5.

Figure 7:
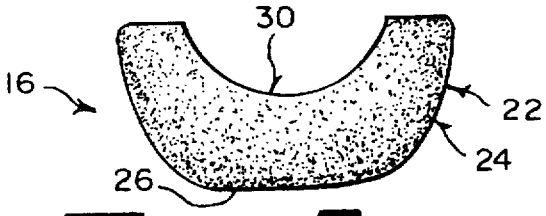

FIG. 7 is a top view taken in the direction of arrow 7 in FIG. 5.

Figure 8:
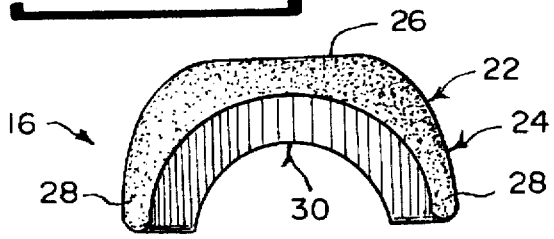

FIG. 8 is a bottom view taken in the direction of arrow 8 in FIG. 5.

Figure 9:
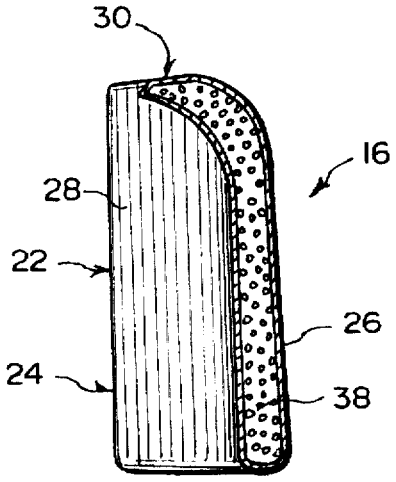

FIG. 9 is a cross sectional view taken along line 9—9 in FIG. 5.

Figure 10:
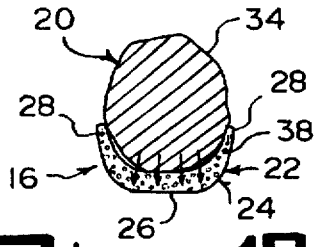

FIG. 10 is a diagrammatic cross sectional view taken along line 10—10 in FIG. 2, showing weight distribution when kneeling.

Figure 11:
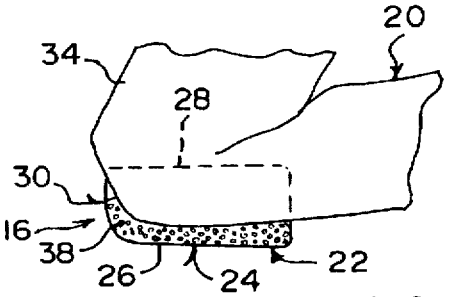

FIG. 11 is a diagrammatic cross sectional view taken along line 11—11 in FIG. 2.

Figure 12A:
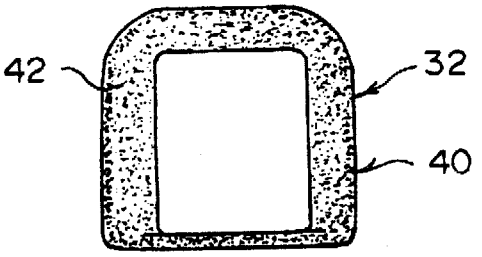
Figure 12:
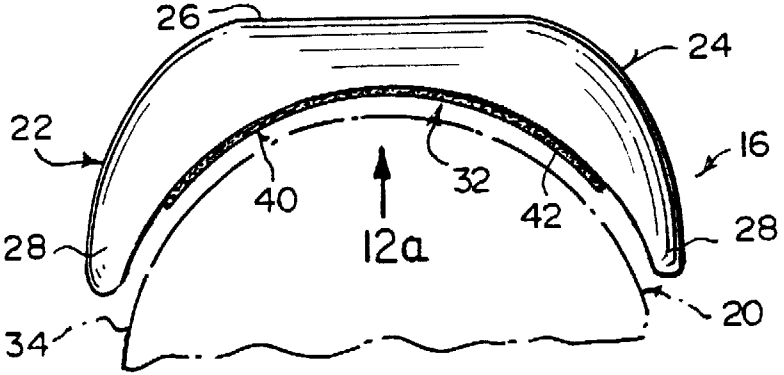

FIG. 12 is a top view of the instant invention being a stick-on style type.

FIG. **12*a* is a rear view taken in the direction of arrow 12*a* in FIG. 12**.

Figure 13A:
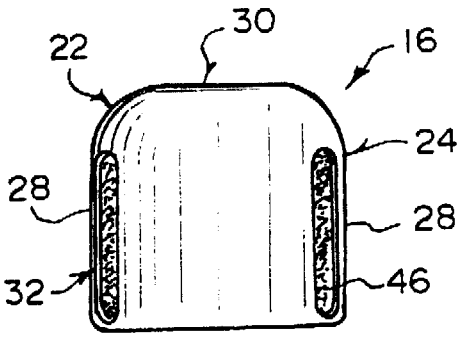
Figure 13:
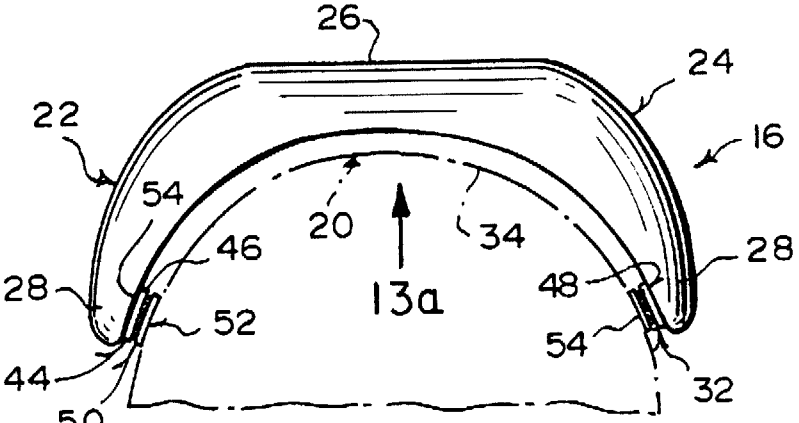

FIG. 13 is a top view of the instant invention being a slap-on style type.

FIG. **13*a* is a rear view taken in the direction of arrow 13*a* in FIG. 13**.

Figure 14:
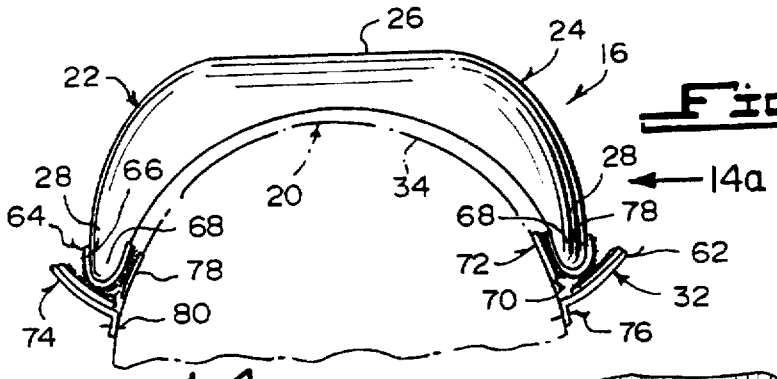

FIG. 14 is a top view of the instant invention being a flap-on style type.

FIG. **14*a* is a side view taken in the direction of arrow 14*a* in FIG. 14**.

Figure 15:
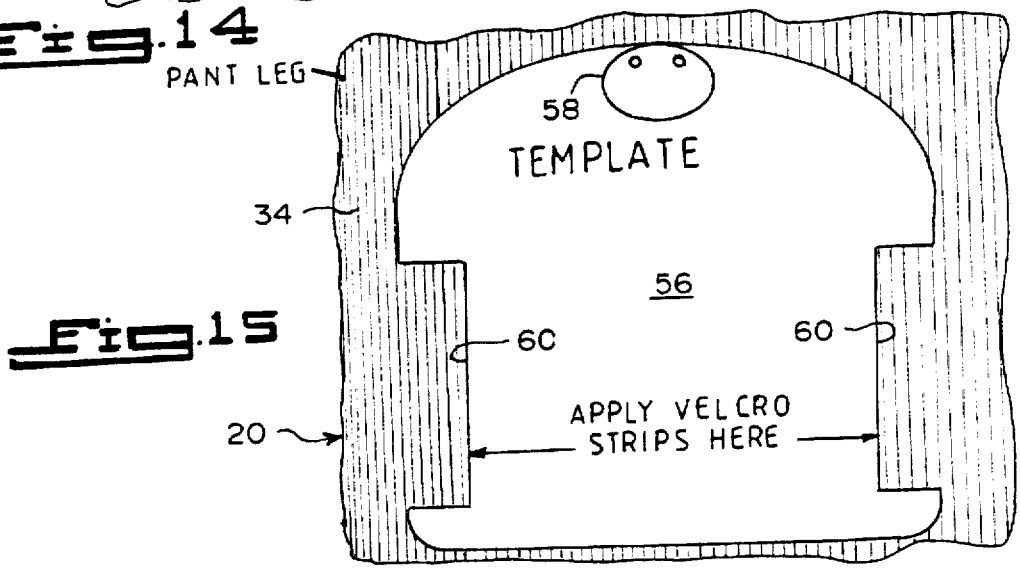

FIG. 15 is an elevational view showing a mounting template on a knee area of a pant leg for the slap-on style type.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through **14*a* illustrate a knee pad 16 for cushioning a knee of a person 18 wearing a pair of pants 20, when the person 18 is in a kneeling position. The knee pad 16 comprises a cushion member 22 being a flexible semi-cylindrical body section 24 having a flat outer surface contact area 26 with tapered sides 28 and an integral flexible quadrispherical cut back top section 30. A facility 32 is for attaching the cushion member 22 in a removable manner to a pants leg 34 of the pair of pants 20 at a knee area. When the person 18 goes into the kneeling position on a floor/ground 36, the cushion member 22 will better conform to the knee of the person 18. The flat outer surface contact area 26 will distribute weight more evenly over a wider surface area on the floor/ground 36 (see FIGS. 2, 10 and 11**).

The cushion member 22 is made from an injection of expanded Ethyl Vinyl Acetate based cross-linking copolymers 38, which is extremely lightweight, has a terrific shock absorption capacity, is elastic rebound with shape retention, has an anti-allergic quality and a tough exterior being non-permeable to dirt, water and oil, that does not depend on specific weight, while it's micro-cellular closed-cell structure contains no Chloro-Fluoro-Carbons (see FIGS. 9, 10 and 11). The attaching facility 32, as shown in FIGS. 3, 12 and 12*a*, is a stick-on style type 40, which is a replaceable double sided soft adhesive patch 42 applied between an inner surface of the flexible semi-cylindrical body section 24 of the cushion member 22 and the outer surface of the pant leg 34 at the knee area.

The attaching facility 32, as shown in FIGS. 13 and 13*a*, is a slap-on style type 44, which consists of a first pair of VELCRO strips 46. A substance 48 is for securing each first VELCRO strip 46 vertically along an inner surface of one tapered side 28 of the flexible semi-cylindrical body section 24 of the cushion member 22. A second pair of VELCRO strips 50 are provided. A substance 52 is for securing each second VELCRO strip 50 vertically along an outer surface of the pant leg 34 at the knee area, so that the first pair of VELCRO strips 46 can mate with the second pair of VELCRO strips 50.

The first securing substance 48 is a permanent adhesive 54, applied between each first VELCRO strip 46 and the inner surface of one tapered side 28 of the flexible semi-cylindrical body section 24 of the cushion member 22. The second securing substance 52 is the permanent adhesive 54, applied between each second VELCRO strip 50 and the outer surface of the pant leg 34 at the knee area.

A template 56 being of a size approximate to the size of the cushion member 22, is shown in FIG. 15, and has a top central pin locator 58 to temporally affix the template 56 to the outer surface of the pant leg 34 at the knee area by a pin. The template 56 further has a pair of side cutout edges 60. Each side cutout edge 60 is approximate the size of one of the second pair of VELCRO strips 50, so that the permanent adhesive 54 can be applied correctly to the outer surface of the pant leg 34 at the knee area.

Figure 14A:
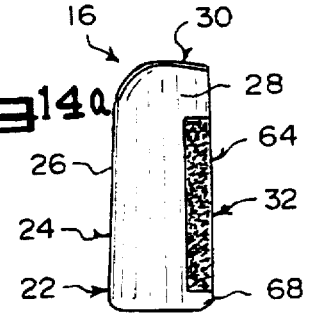

The attaching facility 32, as shown in FIGS. 14 and 14*a*, is a flap-on style type 62 containing a first pair of VELCRO strips 64. A material 66 is for securing each first VELCRO strip 64 vertically around an inner surface and an outer surface at a distal end 68 of one tapered side 28 of the flexible semi-cylindrical body section 24 of the cushion member 22. A second pair of VELCRO strips 70 are provided. A material 72 is for securing each second VELCRO strip 70 vertically along an outer surface of the pant leg 34 at the knee area, so that an inner portion of the first pair of VELCRO strips 64 can mate with the second pair of VELCRO strips 70. A pair of VELCRO flaps 74 are also provided. A material 76 is for securing each VELCRO flap 74 vertically along the outer surface of the pant leg 34 at the knee area, so that an outer portion of the first pair of VELCRO strips 64 can mate with the pair of VELCRO flaps 74.

The first securing material 66 is a permanent adhesive 78 applied between each first VELCRO strip 64 and the inner surface and the outer surface at the distal end 68 of one tapered side 28 of the flexible semi-cylindrical body section 24 of the cushion member 22. The second securing material 72 is the permanent adhesive 78 applied between each second VELCRO strip 70 and the outer surface of the pant leg 34 at the knee area. The third securing material 76 is a thread 80, sewn through each VELCRO flap 74 and into the outer surface of the pant leg 34 at the knee area.

To set each knee pad 16 in the right place, the flexible quadrispherical cut back top section 30 is aligned directly through the center of the person's knee cap. This insures that, as the knee starts to bend, the roundness of the person's own knee cap will align the knee pad 16, so that when the knee is fully bent the knee pad 16 is in exactly the right place.

The flexible quadrispherical cut back top section 30 is the key of how the knee pad 16 works. As soon as the knee is bent, as the clothing stretches against and wraps around the knee, the flexible quadrispherical cut back top section 30 aligns the knee pad 16 to exactly the right spot. Each knee pad 16 set itself in just the right place under the knee, even to the point of twisting the material to get such alignment.

LIST OF REFERENCE NUMBERS

16 knee pad
18 person
20 pair of pants
22 cushion member of 16
24 flexible semi-cylindrical body section of 22
26 flat outer surface contact area on 24
28 tapered side of 24
30 flexible quadrispherical cut back top section of 22
32 attaching facility of 16
34 pants leg of 20
36 floor/ground
38 Ethyl Vinyl Acetate base cross-linking copolymers
40 stick-on style type for 32
42 replaceable double sided soft adhesive patch for 40
44 slap-on style type for 32
46 first VELCRO strip of 44
48 first securing substance of 44
50 second VELCRO strip of 44
52 second securing substance of 44
54 permanent adhesive for 48 and 52
56 template
58 top central pin locator on 56
60 side cutout edge on 56
62 flap-on style type of 32
64 first VELCRO strip of 62
66 first securing material of 62
68 distal end of 28
70 second VELCRO strip of 62
72 second securing material of 62
74 VELCRO flap of 62
76 third securing material of 62
78 permanent adhesive for 66 and 72
80 thread for 76

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A knee pad for cushioning a knee of a person wearing a pair of pants, when the person is in a kneeling position, said knee pad comprising:

a) a cushion member being a flexible semicylindrical body section having a flat outer surface contact area with tapered sides and an integral flexible quadrispherical cut back top section; and b) means for attaching said cusion member in a removable manner to a pants leg of the pair of pants at a knee area, so that when the person goes into the kneeling position on a floor/ground said cusion member will better conform to the knee of the person, while said flat outer surface contact area will distribute weight more evenly over a wider surface area on the floor/ground, said attaching means including:

i) a first pair of hook and loop type fastener strips;

ii) means for securing each said first hook and loop type fastener strip vertically around an inner surface and an outer surface at a distal end of one said tapered side of said flexible semi-cylindrical body section of said cushion member;

iii) a second pair of hook and loop type fastener strips;

iv) means for securing each said second hook and loop type fastener strip vertically along an outer surface of the pant leg at the knee area, so that an inner portion of said first pair of hook and loop type fastener strips can mate with said second pair of hook and loop type fastener strips;

v) a pair of hook and loop type fastener flaps; and vi) means for securing each said hook and loop type fastener flap vertically along the outer surface of the pant leg at the knee area, so that an outer portion of said first pair of hook and loop type fastener strips can mate with said pair of hook and loop type fastener flaps.

2. A knee pad as recited in claim 1, wherein said cushion member is made from an injection of expanded Ethyl Vinyl Acetate based cross-linking copolymers, which is extremely lightweight, has a terrific shock absorption capacity, is elastic rebound with shape retention, has an anti-allergic quality and a tough exterior being non-permeable to dirt, water and oil, that does not depend on specific weight, while it's micro-cellular closed-cell structure contains no Chloro-Fluoro-Carbons.

3. A knee pad as recited in claim 1, wherein said attaching means is a stick-on style type including a replaceable double sided soft adhesive patch applied between an inner surface of said flexible semi-cylindrical body section of said cushion member and the outer surface of the pant leg at the knee area.

4. A knee pad as recited in claim 1, wherein said attaching means is a slap-on style type including:

a) a first pair of hook and loop type fastener strips;

b) means for securing each said first hook and loop type fastener strip vertically along an inner surface of one said tapered side of said flexible semi-cylindrical body section of said cushion member;

c) a second pair of hook and loop type fastener strips; and d) means for securing each said second hook and loop type fastener strip vertically along an outer surface of the pant leg at the knee area, so that said first pair of hook and loop type fastener strips can mate with said second pair of hook and loop type fastener strips.

5. A knee pad as recited in claim 4, wherein said first securing means is a permanent adhesive applied between each said first hook and loop type fastener strip and the inner surface of one said tapered side of said flexible semi-cylindrical body section of said cushion member.

6. A knee pad as recited in claim 4, wherein said second securing means is a permanent adhesive applied between each said second hook and loop type fastener strip and the outer surface of the pant leg at the knee area.

7. A knee pad as recited in claim 1, wherein said first securing means is a permanent adhesive applied between each said first hook and loop type fastener strip and the inner surface and the outer surface at the distal end of one said tapered side of said flexible semi-cylindrical body section of said cushion member.

8. A knee pad as recited in claim 1, wherein said second securing means is a permanent adhesive applied between each said second hook and loop type fastener strip and the outer surface of the pant leg at the knee area.

9. A knee pad as recited in claim 1, wherein said third securing means is a thread sewn through each said hook and loop type fastener flap and into the outer surface of the pant leg at the knee area.

10. A knee pad as recited in claim 2, wherein said first securing means is a permanent adhesive applied between each said first hook and loop type fastener strip and the inner surface and the outer surface at the distal end of one said tapered side of said flexible semi-cylindrical body section of said cushion member.

11. A knee pad as recited in claim 10, wherein said second securing means is a permanent adhesive applied between each said second hook and loop type fastener strip and the outer surface of the pant leg at the knee area.

12. A knee pad as recited in claim 11, wherein said third securing means is a thread sewn through each said hook and loop type fastener flap and into the outer surface of the pant leg at the knee area.

13. A knee pad for cushioning a knee of a person wearing a pair of pants, when the person is in a kneeling position, said knee pad comprising:

a) a cushion member being a flexible semicylindrical body section having a flat outer surface contact area with tapered sides and an integral flexible quadrispherical cut back top section;

b) means for attaching said cusion member in a removable manner to a pants leg of the pair of pants at a knee area, so that when the person kneels, said cusion member will better conform to the knee of the person, while said flat outer surface contact area will distribute weight more evenly over a wider surface area on the floor/ground, wherein said attaching means is a slap-on style type including:

i) a first pair of hook and loop type fastener strips;

ii) means for securing each said first hook and loop type fastener strip vertically along an inner surface of one said tapered side of said flexible semi-cylindrical body section of said cushion member;

iii) a second pair of hook and loop type fastener strips; and iv) means for securing each said second hook and loop type fastener strip vertically along an outer surface of the pant leg at the knee area, so that said first pair of hook and loop type fastener strips can mate with said second pair of hook and loop type fastener strips, said second securing means being a permanent adhesive applied between each said second hook and loop type fastener strip and the outer surface of the pant leg at the knee area: and c) a template being of a size approximately the size of said cushion member and having a top central pin locator to temporally affix said template to the outer surface of the pant leg at the knee area by a pin, wherein said template further has a pair of side cutout edges with each said side cutout edge being approximately the size of one of said second pair of hook and loop type fastener strips, so that said permanent adhesive can be applied correctly to the outer surface of the pant leg at the knee area.

14. A knee pad as recited in claim 13, wherein said first securing means is a permanent adhesive applied between each said first hook and loop type fastener strip and the inner surface of one said tapered side of said flexible semi-cylindrical body section of said cushion member.

* * * * *